US007325790B2

(12) United States Patent
Lee

(10) Patent No.: US 7,325,790 B2
(45) Date of Patent: Feb. 5, 2008

(54) POST SETTING INSERT

(76) Inventor: Gary Lee, Box 61, 12 Brant Street, Shannonville, Ontario (CA) K0K 3A0

( * ) Notice: Subject to any disclaimer, the term of this patent is extended or adjusted under 35 U.S.C. 154(b) by 164 days.

(21) Appl. No.: 11/338,794

(22) Filed: Jan. 25, 2006

(65) Prior Publication Data

US 2007/0170412 A1 Jul. 26, 2007

(51) Int. Cl.
*E04H 12/22* (2006.01)
*E04H 17/08* (2006.01)
*E04H 17/22* (2006.01)

(52) U.S. Cl. ..... 256/65.14; 52/165

(58) Field of Classification Search ..... 256/1, 256/65.14, DIG. 5; 403/311, 344; 248/511, 248/519, 530; 52/40, 126.1, 165, 169.13, 52/170

See application file for complete search history.

(56) References Cited

U.S. PATENT DOCUMENTS 225,683 A * 3/1880 Brady ..... 52/298
612,052 A * 10/1898 McMullen ..... 52/154
962,632 A * 6/1910 Frost ..... 256/32
1,632,965 A * 6/1927 Hays ..... 52/152
3,691,776 A * 9/1972 Hull ..... 405/232
4,079,559 A * 3/1978 Tenbrummeler ..... 52/295
4,269,010 A * 5/1981 Glass ..... 52/154
4,646,489 A * 3/1987 Feller et al. ..... 52/165
4,874,149 A * 10/1989 Miceli ..... 248/530
4,976,040 A * 12/1990 Mish et al. ..... 33/372
D317,725 S * 6/1991 McCord ..... D10/69
5,063,679 A * 11/1991 Schwandt ..... 33/347
5,238,321 A * 8/1993 Jarjoura ..... 403/172
5,421,094 A * 6/1995 McCord et al. ..... 33/373
5,480,126 A * 1/1996 Teasdale ..... 256/19
5,632,464 A * 5/1997 Aberle ..... 248/530
5,636,482 A * 6/1997 Klager ..... 52/165
5,752,349 A * 5/1998 Fitzsimmons et al. ..... 52/165
6,041,559 A * 3/2000 Schickert et al. ..... 52/165
6,073,416 A * 6/2000 Peter ..... 52/736.4
6,098,353 A * 8/2000 Stanfield ..... 52/170
6,138,368 A * 10/2000 Dzierzbicki ..... 33/371
6,308,926 B1 * 10/2001 Meyer ..... 248/530
6,729,089 B1 * 5/2004 Spragg ..... 52/296
6,783,116 B2 * 8/2004 Albritton ..... 256/13.1
6,840,507 B2 * 1/2005 Brown ..... 256/65.01
6,886,296 B1 * 5/2005 John et al. ..... 52/170
7,191,573 B1 * 3/2007 Newton, II ..... 52/736.1
2002/0139069 A1 * 10/2002 Buffkin et al. ..... 52/170
2003/0066198 A1 * 4/2003 Turner ..... 33/370
2003/0233793 A1 * 12/2003 Burkart et al. ..... 52/165

* cited by examiner

*Primary Examiner*—James M. Hewitt
*Assistant Examiner*—Joshua T Kennedy

(57) ABSTRACT

An insert for assisting and easing the task of setting fence posts or the like into a concrete or aggregate footing. The invention comprises: two identical half-forms, which when faced 180 degrees to each other, interlock together to form a full form, a snap-on level, and locking rim. Installing a post into concrete becomes a much-simplified task by means of the present invention whereby, after boring a posthole into the ground, the installer simply snaps together the identical half-forms, snaps on the snap-on level, then casts the now full form into the concrete; adjusting for levelness while placing the concrete into the posthole. No bracing is required since the only force exerted onto the insert. The post can be slid downwardly into the insert once the concrete has set, then slides the locking rim onto the upper edge perimeter of the full form thus creating a quasi-seal surrounding a perfectly level post.

8 Claims, 4 Drawing Sheets

POST SETTING INSERT

FIELD OF THE INVENTION

The present invention relates to an insert for assisting and easing the task of setting fence posts or the like into a concrete footing. The invention comprises: two identical half-forms, which when faced 180 degrees to each other, interlock together to form a full form, a snap-on level, and locking rim. Installing a post into concrete becomes a much-simplified task by means of the present invention whereby, after boring a posthole into the ground, the installer simply snaps together the identical half-forms, snaps on the snap-on level, then casts the now full form into the concrete; adjusting for levelness while placing the concrete into the posthole. No bracing is required since the only force exerted onto the insert. The post can be slid downwardly into the insert once the concrete has set, then slides the locking rim onto the upper edge perimeter of the full form thus creating a quasi-seal surrounding a perfectly level post.

BACKGROUND OF THE INVENTION

For as long as history records, fences have erected using various methods from rock piles to pre-engineered spikes. Yet today, it is most desirable to utilize concrete as a post footing for its obvious strength and stability. However, casting posts into concrete required careful positioning, bracing and maintenance while said concrete sets.

The inventor of the present invention sought to provide installers with a post setting insert, which makes post casting much easier, affordable, and speedier, while helping to prevent moisture from remaining in contact with a post.

Furthermore, occupants of properties bearing posts installed using the method of the present invention can see it possible to remove and replace posts, as they so desire.

Additionally, the two-piece design of the preferred embodiment of the present invention is such that it can be injection-molded in plastic resins without the need for expensive slides in the mould to enable injected parts to be freed from said mould. And that the two-piece design can by packed more compactedly so as to reduce shipping costs is also desirable by the industry.

Accordingly, it is desirable for post installers to have the ability to quickly, simply and affordably cast posts into concrete.

The applicant is aware of several attempts in prior art to provide means of providing a sleeve for the installation of a pole. For example, reference may be had to U.S. Pat. No. 5,752,349 of Fitzsimmons et al., issued May 19, 1998, which describes a sleeve for the placement of a round pole into the ground. While Fitzsimmons' sleeve design is quite suitable for round poles, it serves absolutely no purpose with the use of more commonly used square posts.

Many prior art inventions have succeeded in providing post or pole installers with devices that help simplify the post/pole installation task; none combine the features of simplicity, speediness, affordability, removability and replacability, a snap-on level and reduced shipping space.

SUMMARY OF THE INVENTION

It is thus the object of the present invention to provide post installers with a device that combinedly; helps simplify the task, speeds the process, is affordable, allows removability and replacability of posts, includes a snap-on level and reduced shipping space.

In one aspect of the invention, the post setting insert may be fabricated using any suitable material In another aspect of the invention, the inserts can be made to suit any common-sized post be it 3.5" (8.89 cm) or 5.5" (13.97 cm).

In another aspect of the invention, the insert o the present invention may be cast either in concrete, or directly into the ground.

Accordingly, the post setting insert of the present invention allows post installers with a device that help simplify the task, is simply to use, is fast, affordable, allows removability and replacability of posts, includes a snap-on level and reduces shipping space.

The utility of this post setting insert includes but is not limited to wood posts.

BRIEF DESCRIPTION OF THE DRAWINGS

These and other advantages of the invention will become apparent upon reading the following detailed description and upon referring to the drawings in which.

Figure 1:
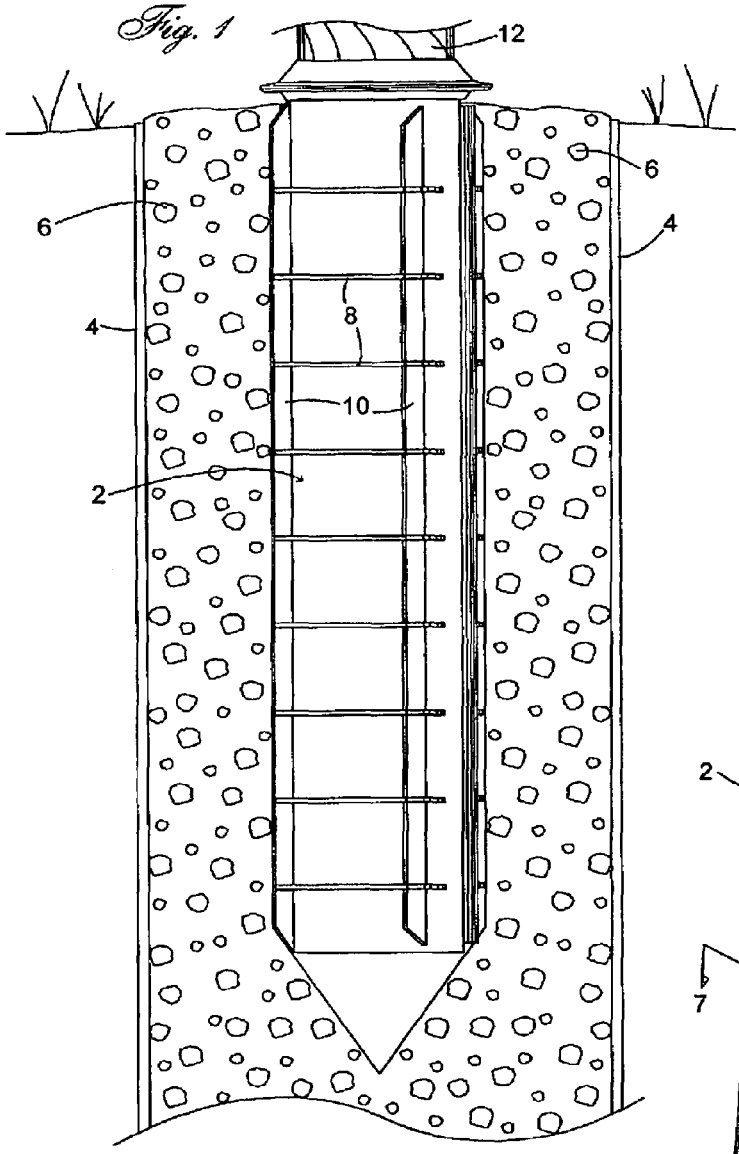
FIG. 1 is a front elevation view of the post setting insert of the present invention as shown cast into a concrete-filled form.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENT

In the following description, similar features in the drawings have been given similar reference numerals.

Turning to FIG. 1, which illustrates an elevation view of the post-setting insert 2 of the present invention cast into a cross-section of a typical tube form 4 filled with concrete 6. Notably, the outer surfaces of the post insert 2 is laden with a plurality of horizontal and vertical webs 8 and 10 protruding outwardly from a planar body forming the general shape of a common fence post 12. It is therefore plain to see that these webs—when embedded into concrete of ground—would immobilize the post insert both on a vertical axis from vertically longitudinal motion. It must be noted that the use of concrete can be substituted with sand, stones, gravel or any material having similar properties.

Figure 2:
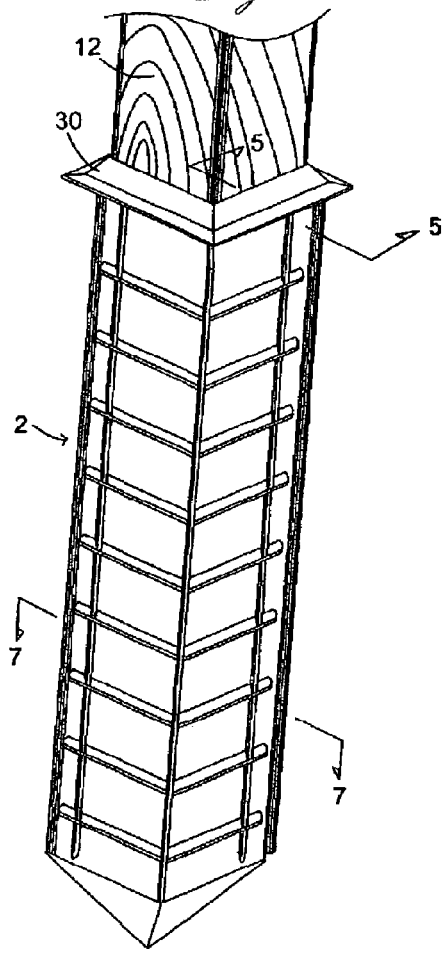
FIG. 2 is a perspective view from above of the post-setting insert of the present invention.

Turning to FIG. 2, illustrating a perspective view from above of the present invention depicting—in perspective—the arrangement of a post inserted within the post-setting insert 2 and adapted with a locking rim 30. Said rim 30 provides three primary functions; firstly, as a decorative cap above the post insert 2, secondly, as a retainer to lock the two identical half-forms together, and thirdly, as a water barrier for the prevention of water entry within the inner portion of the post insert 2.

Figure 3A:
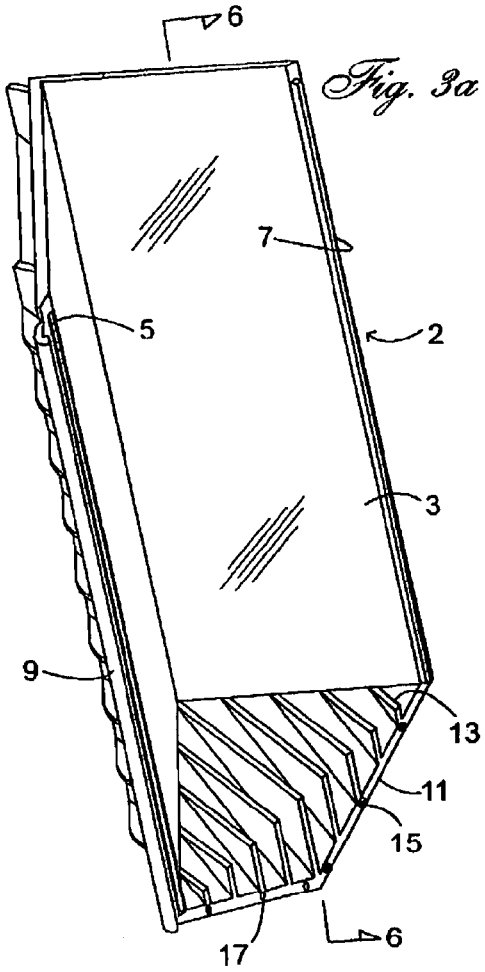
FIGS. 3*a* and 3*b* are perspective views from above of two identical halves of the post-setting insert of the present invention.
Figure 3B:
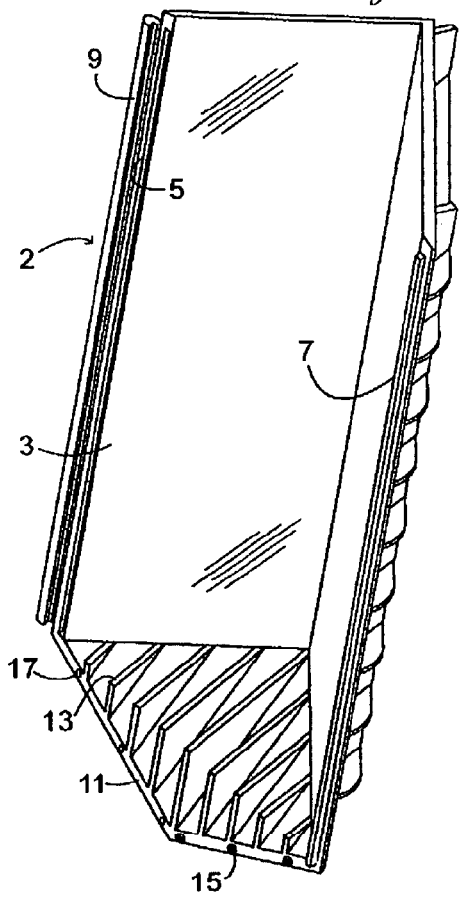

Turning now to FIGS. 3*a* and 3*b*, both perspective views of two identical half-forms comprising: two planar side members 3 jointly molded at one vertical edge so as to form an L shape when viewed from above, a female joiner 5 at one extremity, and a male joiner 7 both inwardly and diagonally disposed at the opposing extremity of said L-shaped side members 3, a catch strip located at the outer surface of the side member 3 closest to the male joiner 7, a latch strip 9 located at the outer surface of the side member 3 closest to the female joiner 5, a pointed bottom 11 resembling an inverted semi-pyramid filled only with upwardly protruding triangular webs 13 disposed in such a manner to simulate a flat inner bottom portion where a post can be firmly seated, a plurality of alignment nipples 15 protruding outwardly from one half of the vertical edge of the pointed bottom portion 11, and nipple bores 17 positioned at the opposing half of the vertical edge of the pointed bottom portion 11 so as to align with a same half form to form a full form.

Figure 4:
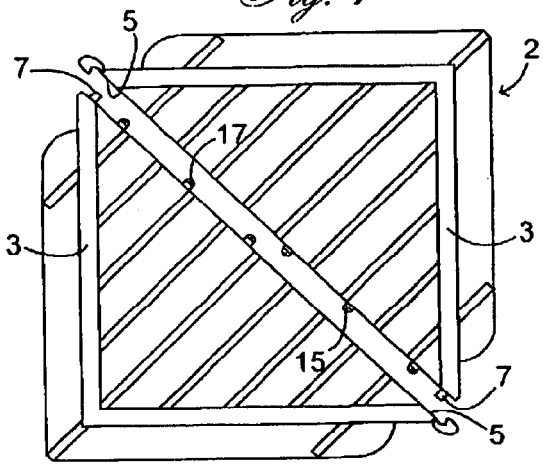
FIG. 4 is a top plan view of the post-setting insert of the present invention.

FIG. 4 depicts a top plan view of two half-forms in an approach for alignment. It can be seen in more details now that the alignment nipples 15 can therefore enter the nipple bores 17, and the male joiners 7 enter the female joiners 5 thus promoting dimensional and structural integrity between the two half-forms. Additionally, this may be a preferred illustration to note that in molding this part, there are no special requirements to allow for hidden or locked portions that would normally require mechanical slides in order to remove such part from the mould. On the contrary, the line of draw—in reference to this figure is 45 degrees N-E, S-W.

Figure 5:
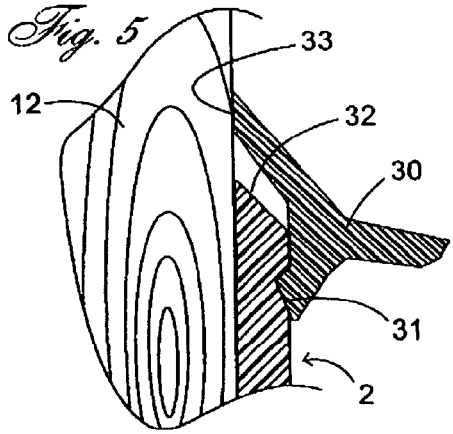
FIG. 5 is a cross-sectional view taken along the lines 5-5 of FIG. 2 of the post-setting insert of the present invention.

FIG. 5 is a cross-sectional view taken from FIG. 2 whereby the illustration depicts the locking rim 30 snapped onto the rim latch 31 at the upper outer portion of each half-form 3 thus the locking rim 30 thereby creates a peripheral band about the perimeter of the now full form. The upper most edge 32 of each half-form is tapered outwardly and downwardly so as to ease the installation of said locking rim 30. This figure also illustrates how the upper inner edge 33 of the locking rim 30 mates frictionally against the outer periphery of a post 12 so as to perform a general seal about said post's periphery thereby aiding in preventing moisture from entering the post-receiving cavity of the full form assembly.

Figure 6:
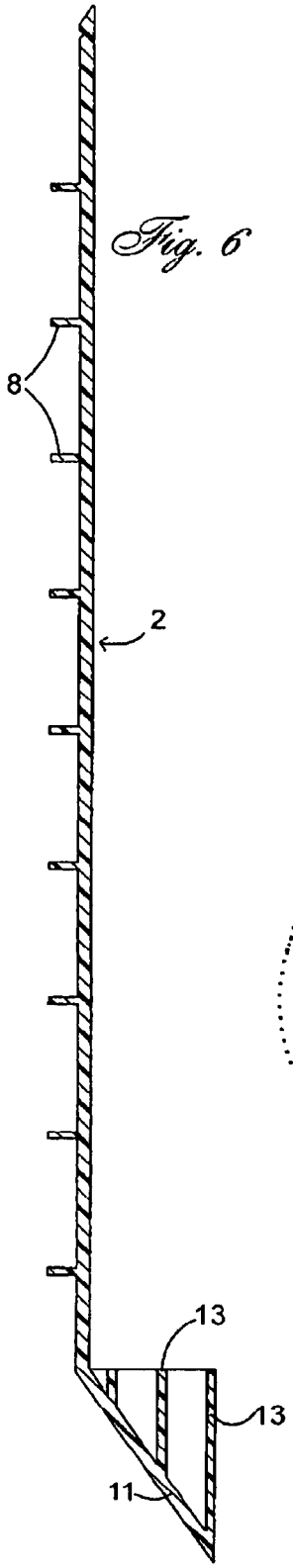
FIG. 6 is a cross-sectional view taken along the lines 6-6 of FIG. 3*a* of the post-setting insert of the present invention.

FIG. 6, a cross-sectional view taken along the lines 6-6 of FIG. 3*a* illustrates two primary features of the present invention wherein, a plurality of horizontal webs 8 integrally molded with the planar side members 3 provide dimensional and structural support of the post insert 2 during the casting step of installation. This is to ensure that the inner post-receiving cavity remains dimensionally correct during and after casting so as to allow a post to enter said cavity once casting has set. The pointed bottom 11 incorporates a smooth finish at its outer surface to promote easy entry into the casting material, and vertically oriented triangular webs 13 integrally molded with the pointed bottom 11 wherein the upper ends of each web 13 is horizontally even with each other web 13 so as to form an intermittent floor on which a post's butt end can rest upon thus evenly distributing the post's load to the intermittent floor. Furthermore, any moisture or water, which enters the post-receiving cavity, would find its way down between the webs 13 thus aiding the post to remain dry.

Figure 7:
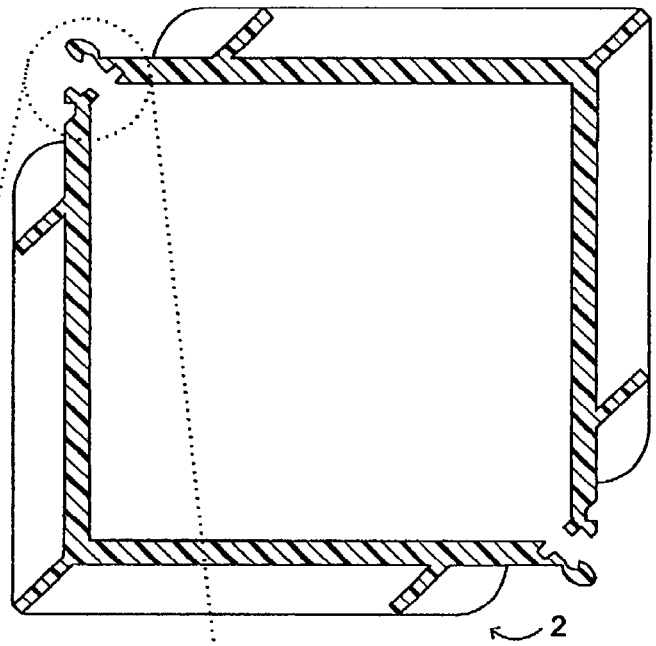
FIG. 7 is a cross-sectional view taken along the lines 7-7 of FIG. 2 of the post-setting insert of the present invention excluding the post.
Figure 8A:
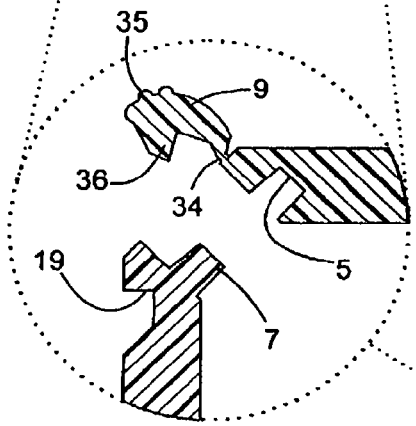
FIG. 8*a* is a selected view taken from FIG. 7 of the closure portion of the post-setting insert of the present invention in an opened attitude.
Figure 8B:
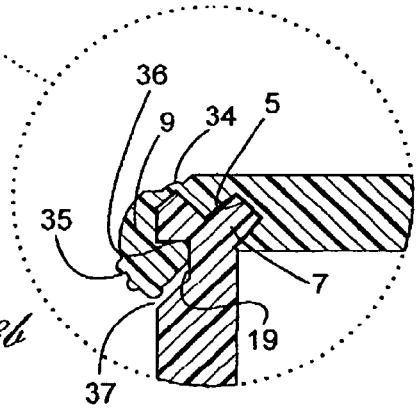
FIG. 8*b* is a continuation of the selected view taken from FIG. 7 of the closure portion of the post-setting insert of the present invention in a closed position.

FIGS. 7, 8*a* and 8*b* will attempt to illustrate the joinery between two half-forms, to form a full form wherein, FIG. 7 illustrates the approach of two identical half-forms as one is rotates 180 degrees about a vertical axis. FIG. 8*a*, a selected view taken from FIG. 7, illustrates in detail, a cross-section of both half-forms about to mate together wherein, a male and female joiner 7 and 5 are both tapered so as to better form a seal when mated, and wherein a catch 19 within one half-form receives a latch 9 integrally molded with the mating half-form, and said latch incorporates a flex hinge 34 also integrally molded with the half form. The latch 9 incorporates one or more grips 35 to ease the transfer of force applied by the installer's finger against said latch 9. FIG. 8*b* now depicts the joinery of both half-forms into a full form wherein, once engaged, the male and female joiners 7 and 5, mate frictionally to form a general seal, the latch 9 having a hook portions 36, engages within a catch 19 within the mating half-form to lock both half-forms together. Additionally, a small release space 37—suitable for the insertion of a flat rigid object—remains in the event that the installer desires to disengage the latch 9 from the catch 19.

Figure 9:
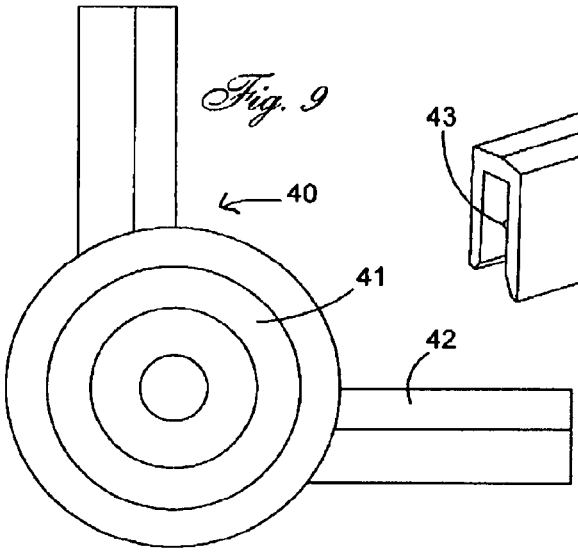
FIGS. 9 and 10 are respectively top plan and perspective views of the snap-on level of the post-setting insert of the present.
Figure 10:
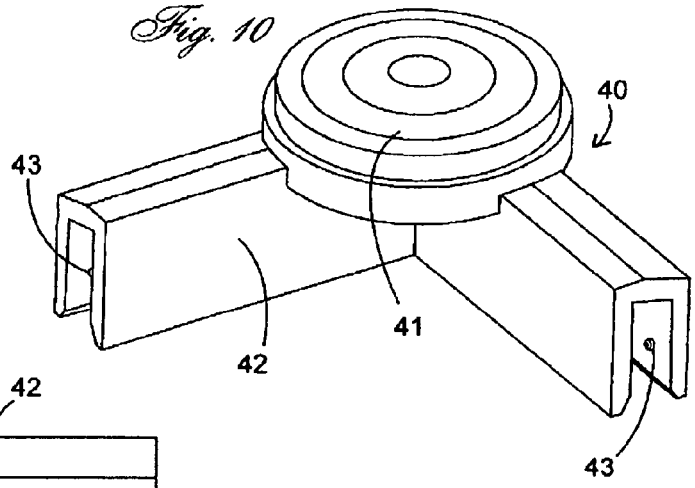

FIGS. 9 and 10 now illustrate the embodiment of a snap on level 40 of the present invention comprising; a common round-center-level 41 fixedly attached to an L-shaped snap frame 42. Said snap frame 42 having a generally inverted U-shaped cross-section wherein, the inner surface of the U-shaped section has a width equal or slightly greater than the thickness of the planar side members of the half-forms so as to frictionally engage atop the upper portion of said planar side members. Two or more snap nipples 43 integral with the outer most inner surface of the U-shaped section are positioned so as to temporarily snap into the rim latch at the upper outer portion of each half-form. Said snap nipples 43 simply ensure the snap level 40 is truly placed upon the upper outer portion of each half-form.

Figure 11:
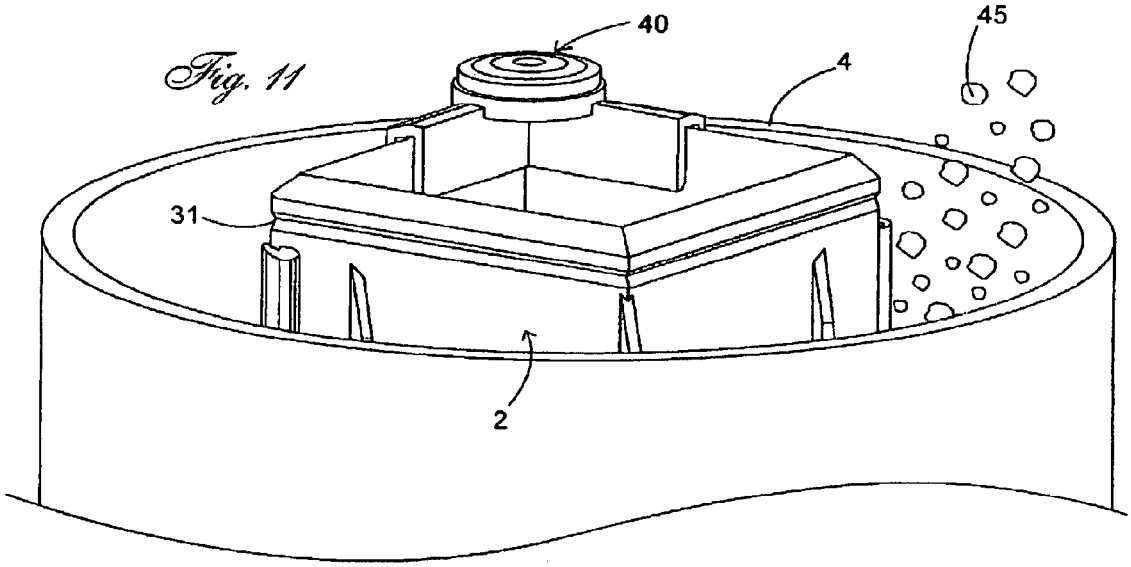
FIG. 11 is a perspective view from above of the post-setting insert of the present invention illustrating its installation within a tube form.

FIG. 11 depicts a partial view of the post setting insert as being installed within a typical tube form 4 wherein, once the two half-forms are locked together—forming a full form—and the snap-on level 40 is temporarily snapped onto the rim latch at the upper outer portion at a corner of the now full form, concrete, sand, gravel or any suitable fill material 45 is places within the tube form 4 outside the post-setting insert 2 to a level slightly below the rim latch 31 at the upper outer portion of the insert 2. The installer can then adjust the post-setting insert 2 for levelness in accordance the reading provided by the snap-on level 40 until the fill material 45 reaches a height slightly below said rim latch 31. The snap-on level 40 can then be removed and used on the next post installation. Once the fill material is set, a post can then be frictionally inserted within the cavity formed by the post insert 2 and the locking rim slipped over and around said post and snap-locked in position in accordance with the details of FIG. 5. Conversely, a post installed with the system of the present invention may be removed and replaced at the user's discretion by forcing the locking rim upwardly, releasing its grip around the post insert, then pulling up said post out of the post insert 2.

Therefore, it is now possible, through the use of the post-setting insert of the present invention, to provide post installers with a device that: help simplify the task, is simply to use, is fast, is affordable, allows removability and replacability of posts, includes a snap-on level while reducing shipping space.

What I claim as my invention:

1. A post-setting insert comprising:

i. a ground-inserting portion having:

(a) two half-form, each comprising two planar side members jointly molded at one vertical edge so as to form an L shape when viewed from above, (b) a female joiner inwardly and diagonally disposed at one extremity of the planar side member, and a male joiner outwardly and diagonally disposed at the opposing extremity of said L-shaped side members, (c) a closure latch integral to one edge of the planar side member, (d) a closure catch integrally molded into one edge of the planar side member distal to the closure latch, and (e) a rim latch at the upper outer periphery of each half-form member, ii. a locking rim having:

(f) a rim portion having inner dimensions conforming to those of two half-forms' upper edges' outer dimensions when joined, (g) a gripping portion extending outwardly and slightly downwardly from the rim portion, (h) a snap rib integral with the inner portion of the rim portion and geometrically similar to the geometry of the rim latch at the upper outer periphery of each half-form member, (i) an upwardly and inwardly extending cap portion also integrally attached with the rim portion and having inner dimensions generally conforming to those of the outer dimensions of a post for which the post-setting insert of the present invention was adapted, iii. a snap-on level having:

(a) a round level wherein the upper center is the level position indicator, (b) a snap frame having a generally inverted U-shaped cross-section wherein, the inner surface of the U-shaped section has a width equal or slightly greater than the thickness of the planar side members of the half-forms so as to frictionally engage atop the upper portion of the planar side members, (c) two or more snap nipples integral with the outer most inner surface of the U-shaped section are positioned so as to temporarily snap into the rim latch at the upper outer portion of each half-form.

2. The post-setting insert of claim 1 wherein, the contacting surfaces of the two half forms are disposed in such a manner that each opposing edge conforms fittingly with its opposing half by means of male and female joinery so as to allow two identical half forms to fittingly mate together.

3. The post-setting insert of claims 1 or 2 wherein, the opposing half forms are securedly attached together by means of a catch and latch integral with its respective edge.

4. The post-setting insert of claim 1 wherein, the bottom portion of the full form assembly is pointed downwardly.

5. The post-setting insert of claim 4 wherein, the downwardly pointed bottom portion of each post setting insert half-form has vertically oriented triangular webs integrally molded with the pointed bottom wherein the upper ends of each web is horizontally even with each other web so as to form an intermittent floor on which a post's butt end can rest upon thus evenly distributing the post's load to the intermittent floor.

6. The post-setting insert of claim 5 wherein, any moisture or water, which enters the post-receiving cavity, would find its way down between the webs thus aiding the post to remain dry.

7. The post-setting insert of claim 1 wherein, the upper outer edge of each half form is adapted with a rim latch comprising a continuous V-groove along the outer portion of each half form.

8. The post-setting insert of claim 1 wherein, the locking rim, when frictionally and pressuredly inserted over the full form assembly, creates a periphery ring therearound.

* * * * *